United States Patent [19]

Gasperini et al.

[11] 4,242,093

[45] Dec. 30, 1980

[54] DOUBLE-FACE DYEING AND PRINTING OF POLYESTER FABRICS WITH DISPERSE DYES

[75] Inventors: Pietro Gasperini, Seveso; Francesco Brunetti, Chieri, both of Italy

[73] Assignee: Aziende Colori Nazionali Affini Acna S.p.A., Milan, Italy

[21] Appl. No.: 46,430

[22] Filed: Jun. 7, 1979

[30] Foreign Application Priority Data

Jun. 8, 1978 [IT] Italy ..... 24321 A/78

[51] Int. Cl.[3] ..... D06P 3/00; D06P 3/80; D06P 5/00

[52] U.S. Cl. ..... 8/456; 8/672

[58] Field of Search ..... 8/17, 174

[56] References Cited

U.S. PATENT DOCUMENTS 3,775,046 11/1973 Harper et al. ..... 8/17

FOREIGN PATENT DOCUMENTS 49-32752 9/1974 Japan ..... 8/17
50-197512 12/1975 Japan ..... 8/17
53-197803 3/1978 Japan ..... 8/17
53-197804 4/1978 Japan ..... 8/17

*Primary Examiner*—William F. Hamrock
*Attorney, Agent, or Firm*—Morgan, Finnegan, Pine, Foley & Lee

[57] ABSTRACT

There is provided a process for the dyeing and printing of polyester textile fabrics with different shaded color effects on one or both sides of the fabric, comprising contacting the polyester fabric as such or having been previously dyed in light pastel shades, with an aqueous dye bath containing at least one hydrophobizing substance, drying the so-treated fabric, printing on one or both sides thereof with disperse dyes and affixing the dyes to the surface by thermosoling.

2 Claims, No Drawings

DOUBLE-FACE DYEING AND PRINTING OF POLYESTER FABRICS WITH DISPERSE DYES

FIELD OF THE INVENTION

The present invention concerns a process for the dyeing and printing of polyester fabrics with disperse dyes.

More particularly, the present invention relates to a dyeing and printing process for polyester fabrics with disperse dyes, which process allows to obtain on both the faces of the fabric differently shaded color effects which are light fast and resistant to wet treatments and, in particular, are resistant to rubbing, the final hand of the fabric remaining very "soft".

BACKGROUND OF THE INVENTION

There are known processes that permit the dyeing of fabrics only on one face with one dye or on both faces with dyes different from each other, by means of the pigment printing technique, that is, by using binding resins that fix the dye to the textile support.

One of these processes is described, for instance, in U.S. Pat. No. 3,775,046, which relates to the selective dyeing of cotton fabrics and polyester-cotton blends. Such processes, although imparting dyeings and printings which are, in general, sufficiently resistant to wet treatments, also confer on the fabric too stiff a hand.

Also known are processes that allow printing on both faces of a fabric by means of the transfer printing technique—a method which foresees the printing of a pattern onto an intermediate support, generally paper. Successively, the printed pattern is transferred onto the fabric by coupling together the support with the fabric itself and then subjecting the same to a heat treatment under pressure. The principle of this technique is described, for instance, in U.S. Pat. No. 3,874,846, concerning printing on both faces of synthetic fabrics, such as polyesters, polyamides, etc. Such processes are, however, very laborious because they require two successive printing operations, that is the printing of the intermediate support and that of the final support. Moreover, the light fastness and the sublimation of the prints from the final support are, in general, rather infrequent.

OBJECTS OF THE INVENTION

It has now been surprisingly discovered that it is possible to obtain on both faces of a polyester fabric differentiated color effects which are very fast to light and resistant to wet treatments, in particular to rubbing, by means of a process which comprises a preliminary treatment of said fabrics with suitable hydrophobizing substances and the successive application of disperse dyes.

The fabrics dyed with this process, object of the invention, have a much softer touch in comparison with fabrics obtainable by pigment printing. In fact, this touch is comparable with that achieved in the continuous dyeing with the foulard-thermosol method. Moreover, the fabrics thus dyed are receptive to any kind of finishing, such as waterproofing, fireproofing, etc.

A further object of this invention is that of providing a process that offers the possibility to combine the dyeing and printing of polyester fabrics, thereby obtaining multiple coordinated color effects that will meet the changing requirements of fashion.

The foregoing objects are achieved by the invention herein described.

DESCRIPTION OF THE INVENTION

According to the invention, there is provided a process for the dyeing and printing of polyester textile fabrics to achieve differently shaded effects on one or both faces of the fabric, the process comprising:

(a) contacting a polyester fabric, undyed or previously dyed in light pastel shades with an aqueous bath comprising one or more hydrophobizing substances;

(b) drying the treated fabric from step (a);

(c) printing one or both faces of the fabric with disperse dyes;

(d) affixing the dyes to the textile fabric surface by use of thermosoling; and (e) recovering the textile fabric.

The process of this invention is particularly suited for the "double-face" dyeing and printing of polyester fabrics intended for furnishings, such as curtains, tapestries, etc.

The process of this invention may also be conveniently used in the dyeing and printing of articles destined for clothing such as "double-face" raincoats, shaded articles, mottled articles, etc.

As far as the practical embodiment of this invention is concerned, one may proceed as described hereunder.

After eliminating from the fabric the spots and dirt accumulated on the fabric during the weaving and storing of the raw material, for instance, by a simple treatment at 80° C. in the presence of about 4 g/lt. of sodium perborate, followed by a rinsing in water, one proceeds to treat the fabric on a foulard with a bath containing hydrophobizing substances such as, for instance, aqueous paraffin emulsions of the NORANE PH type (trade mark of the Italian Company ROL), thereafter subjecting the fabric, after drying, to printing and doctoring with pastes containing disperse dyes, a thickener, an organic acid and water, alternating on both faces or possibly on only one of them in the event there had previously been carried out the dyeing of the fabric in a dyeing bath.

As thickening substances there may be conveniently used the substances derived from cellulose or carob seed flour, as such, or modified. Not suitable, on the other hand, are the thickening substances on an alginic base, probably because they have an undesirable penetrating effect.

As far as the paste composition is concerned, it is altogether the same for the printings as well as for the doctoring. In the latter case, however, the viscosity must be slightly higher.

One of the most convenient compositions is as follows:

| | Printing | Doctoring |
|---|---|---|
| Dye (g/kg) | x | x |
| 80% acetic acid (cu.cm./kg) | 2 | 2 |
| Indalca H 7310 10% (g/kg) | 500 | 600 |
| Water | to make | to make |
| | 1 kg | 1 kg |

The doctoring may be carried out either uniformly or in zones.

After the doctoring or the printing operations, there is carried out the drying (1–5 minutes) by using an infrared (IR) apparatus or a hot-air tenter-frame dryer.

Subsequently, using suitable equipment, there is carried out the thermosoling, at temperatures varying from 200° to 220° C. (for 1–3 minutes), in order to obtain the fixing of the dye ont the support (textile).

The unfixed dye and the residual thickening substance are removed from the fabric by an alkaline-reducing washing in a bath containing caustic soda and hydrosulphite.

After the washing and drying, there is carried out the desired finishing.

DESCRIPTION OF THE PREFERRED EMBODIMENTS

The following examples illustrate in further detail, but without any intention to be limiting.

EXAMPLE 1

A 100% polyester fiber fabric (having a weight of about 330 g/m$^2$) was foularded with a slightly acid aqueous emulsion, acid for acetic acid and containing 50 g/lt of NORANE FH (ROL). The pick-up proved to be equal to 50%. After drying, the fabric was subjected to doctoring (on a BENZ laboratory doctoring frame) with the following paste (A):

| PASTE A | |
|---|---|
| TURCHESE TERSETILE GL (ACNA S.p.A.) (C.I. Disperse Blue 60) | 40 g/kg. |
| BLU TERSETILE 2BL (ACNA S.p.A.) (C.I. Disperse Blue 73) | 20 g/kg. |
| INDALCA H 7310 at 10% conc. (CESALPINA S.p.A.) | 600 g/kg. |
| 80% ACETIC ACID | 2 cc/kg. |
| WATER | to make 1 kg. |

Thereupon the material was dried at 120° C. for 2 minutes on a tenter frame (BENZ laboratory tenter). The fabric was then thermosolated in hot air at 200° C. for 3 minutes on a BENZ laboratory apparatus. Successively, there was carried out the alkaline-reducing stripping at 90° C., in the presence of 6 cc/lt of NaOH 30°Bé and 3 g/lt. of ALBITE A (Montedison). The fabric turned out to be dyed on only one face in a deep turquoise blue, was very fast to light and resistant to wet treatments, and had a soft touch.

The reserve of the other face was good.

Operating as previously described, but using a nonhydrophobized fabric, the reserve effect obtained on the second face was much inferior.

EXAMPLE 2

The procedure of Example 1 was repeated, but using the following paste (B):

| PASTE B | |
|---|---|
| GIALLO TERSETILE 6GL (ACNA S.p.A.) (C.I. Disperse Yellow 88) | 3.5 g/kg |
| TURCHESE TERSETILE GL | 60 g/kg |
| BLU TERSETILE 2BL | 2 g/kg |
| INDALCA H 7310 at 10% conc. | 600 g/kg |
| ACETIC ACID at 80% conc. | 2 cc/kg |
| WATER | to make 1 kg |

There was likewise obtained a fabric dyed on one face only with a beautiful light green shade, its characteristics corresponding to those of the preceding dyeing obtained with paste (A).

EXAMPLE 3

Using the same methods illustrated in Example 1, there were carried out with the pastes (A) and (B) alternated doctorings on both faces of the fabric. Thereby was obtained a fabric dyed with a double-face effect of two colors, turquoise blue and bright green, characterized by a particularly soft touch.

The fastnesses to light, thus achieved, corresponded to the degree 6–7/7 of the scale of blues. Also the fastness to moisture, and, in particular, to rubbing, proved excellent and absolutely comparable with those obtained with standard dyeing processes.

EXAMPLE 4

A 100% polyester fabric, preliminarily dyed in a light pastel shade by the use of a standard process and equipment for polyester fibres, was hydrophobized and printed according to the procedures described in Example 1. As in Example 1, there was obtained a fabric endowed with a very soft touch and with multicolor shades that were very fast to light and resistant to wet treatments.

We claim:

1. A process for the dyeing and printing of polyester textile fabrics to achieve differently shaded color effects on one or both faces of the fabric, comprising:

(a) contacting at room temperature a polyester textile fabric, undyed or previously dyed in light pastel shades, with a slightly acidic aqueous emulsion of a paraffin wax;

(b) drying the treated fabric from step (a);

(c) printing at room temperature one or both faces of the fabric with a paste comprising disperse dyes, a thickener, an organic acid and water;

(d) affixing said dyes to the textile fabric surface by thermosoling at 180°–220° C.; and (e) alkaline-reducing washing said textile fabric at 70°–150° C.

2. The process of claim 1 in which in step (c) only one face of the fabric is provided with a disperse dye, the opposite face of the fabric having previously been dyed before treatment with said process.

* * * * *